US005221117A

United States Patent [19]

Messinger et al.

[11] Patent Number: 5,221,117

[45] Date of Patent: Jun. 22, 1993

[54] FULLY ROTATABLE VACUUM LIFT WITH SELF CONTAINED UTILITY LINES

[76] Inventors: Robert A. Messinger, 353 Circle Dr.; David L. Seelig, 670 Lime St., R.D. #3, both of Palmerton, Pa. 18071

[21] Appl. No.: 876,110

[22] Filed: Apr. 30, 1992

[51] Int. Cl.[5] ..... B66C 1/02

[52] U.S. Cl. ..... 294/64.1; 414/627

[58] Field of Search ..... 294/64.1, 86.4; 414/627; 901/40; 439/191, 192, 194, 195, 41; 15/314, 321, 377

[56] References Cited

U.S. PATENT DOCUMENTS

| | | | |
|---|---|---|---|
| 2,591,250 | 4/1952 | Gerber | 15/377 X |
| 3,318,468 | 5/1967 | Olson | 294/64.1 X |
| 3,884,363 | 5/1975 | Ajlouny | 294/86.4 X |
| 4,062,485 | 12/1977 | Andersen | 294/86.4 X |
| 4,413,853 | 11/1983 | Andersson | 294/64.1 |
| 4,473,923 | 10/1984 | Neroni et al. | 439/191 X |
| 4,517,404 | 5/1985 | Hughes et al. | 439/191 X |
| 4,557,659 | 12/1985 | Scaglia | 294/64.1 X |
| 4,683,912 | 8/1987 | Dubrosky | 294/86.4 X |
| 5,035,456 | 7/1991 | Messinger | 294/64.1 |

*Primary Examiner*—David M. Mitchell
*Assistant Examiner*—Dean J. Kramer
*Attorney, Agent, or Firm*—Laurence R. Brown

[57] ABSTRACT

An auxiliary energy source is connected to the manually operated lift head of a vacuum lift system for connection of an accessory. Thus, electrical or compressed air energy is made conveniently available to power a load rotating accessory, a clamp, or the like, preferably by means of feeding a conduit line coaxially within the flexible tubing of the lift system. This is particularly useful to prevent interference or disarray of an auxiliary line that must be manipulated in tandem with the lift head, and is operable with rotary type lift systems that permit 360 degree rotation of the lift head.

13 Claims, 2 Drawing Sheets

FULLY ROTATABLE VACUUM LIFT WITH SELF CONTAINED UTILITY LINES

TECHNICAL FIELD

This invention relates to vacuum lift systems having a flexible tubing connecting a manually operable load lift head to a vacuum power source, and more particularly relates to such lift systems with rotary couplers that permit the lift head to be rotated 360 degrees.

BACKGROUND ART

It has been a problem in the art of vacuum lift systems to provide complete flexibility in the handling and positioning of loads. Some loads such as burlap bags cannot efficiently be grasped by the vacuum lift head directly and thus auxiliary clamping accessories are desirable. Other types of loads such as rolls may require rotation about their axis in moving from a horizontal position on a pallet to a vertical position on a spindle, and thus an auxiliary powered rotating mechanism is desirable. However, heretofore the supply of power to the auxiliary accessories has created safety and ergonomic problems, because electric line cords or pneumatic lines tend to snag, trip operating personnel or become twisted, coiled and untidy in the course of use.

A further problem is incurred in handling of loads with vacuum lift systems in that complete flexibility of movement of the load is restricted by the necessity to convey the vacuum energy through sealed conveyance paths that do not readily accommodate movable joints. Thus, if a rotatable joint is considered desirable for better manipulation of the lift head and accompanying load, the necessity of providing a conventional vacuum sealed joint introduces short wear life and significant friction that defeats the purpose of reducing manual work to a minimum. Also rotary joints do not easily accommodate the conveyance of two diverse sources of power to the lift head, particularly if one source of power is a pneumatic tube for carrying compressed air. Limitation of rotary joints to less than 360 degree rotation for accommodating auxiliary power lines, so that they do not become entangled sacrifices the freedom to position loads universally in any degree of motion.

It is accordingly an object of this invention to provide an auxiliary source of power at the lift head for with accessories that is safe, neat and convenient to use.

It is a further object of this invention to provide an improved rotary joint that requires little manual effort and permits 360 degree rotation.

DISCLOSURE OF THE INVENTION

Full rotation of the lift head is achieved by an improved ball bearing rotary joint configuration that is compatible with vacuum sealing requirements, 360 degree rotation and little manual effort. Thus, one bearing race is attached to a mounting head and a mating race is attached to the flexible vacuum lift tubing with substantially frictionless, long life, vacuum seal gasket structure. An auxiliary utility line is fed through the rotary joint coaxially within the surrounding flexible vacuum lift tubing in a manner that accommodates a safety valve that assures gentle lowering of a load in the event of vacuum power loss. Within the flexible tubing the auxiliary utility line, which may be an electric cable or a pneumatic tubing for carrying compressed air, for example, the line is coiled as a flexible spring which moves flexibly with the lift assembly as the load is manipulated from place to place and is positioned by rotation about the rotary joint.

Other features, objectives and advantages of this invention will be found throughout the following description, accompanying drawing and appended claims.

BRIEF DESCRIPTION OF THE DRAWINGS

In the accompanying drawings, wherein like reference characters identify similar features throughout the various views.

THE PREFERRED EMBODIMENT

Figure 1:
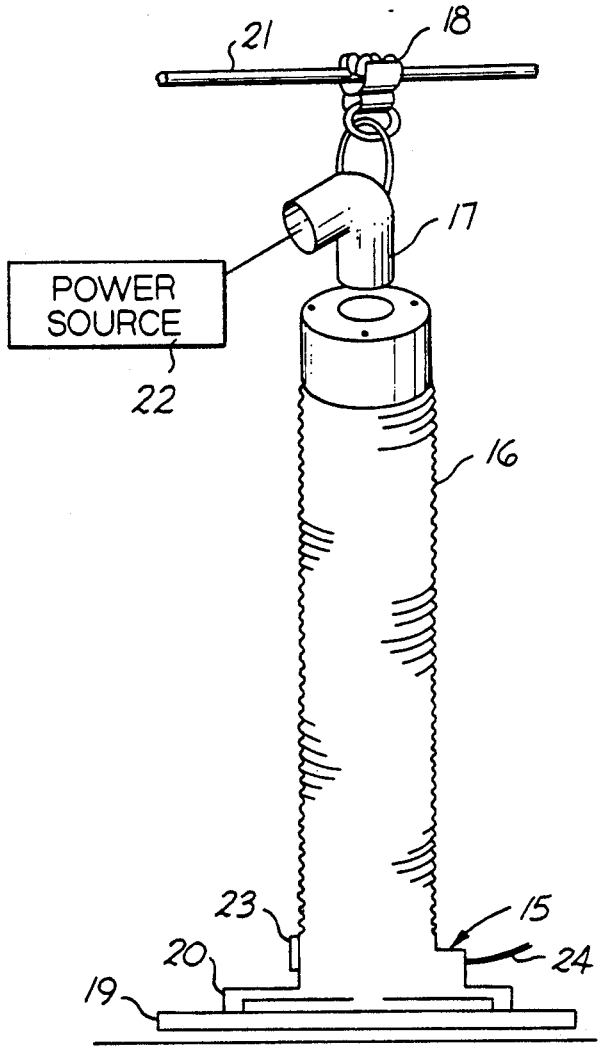
FIG. 1 is a diagrammatic sketch of the improved rotary head vacuum lift system afforded by this invention.

With reference to FIG. 1, a vacuum lift system embodiment 15, having a flexible tubing 16 rotatable about a mounting head 17, is shown. Such vacuum operated lifts coupled to track 21 by attachment means 18 thus can lift, manipulate, and transport a load 19 is rotatable with the flexible tubing 16 about the head 20. The relatively fixed mounting head 17 as diagrammatically indicated. The power source 22 provides vacuum lift energy manually controlled by release valve handle 24, preferably in the manner described in my U.S. Pat. No. 5,035,456 issued Jul. 30, 1991 for Vacuum Control System for Lifting Systems. Also a second auxiliary power source may provide energy at the lift head outlet 23 in accordance with this invention, such as electricity or compressed air, preferably by means of a utility line internally disposed in flexible tube 16 from power source 22 to outlet 23.

Figure 2:
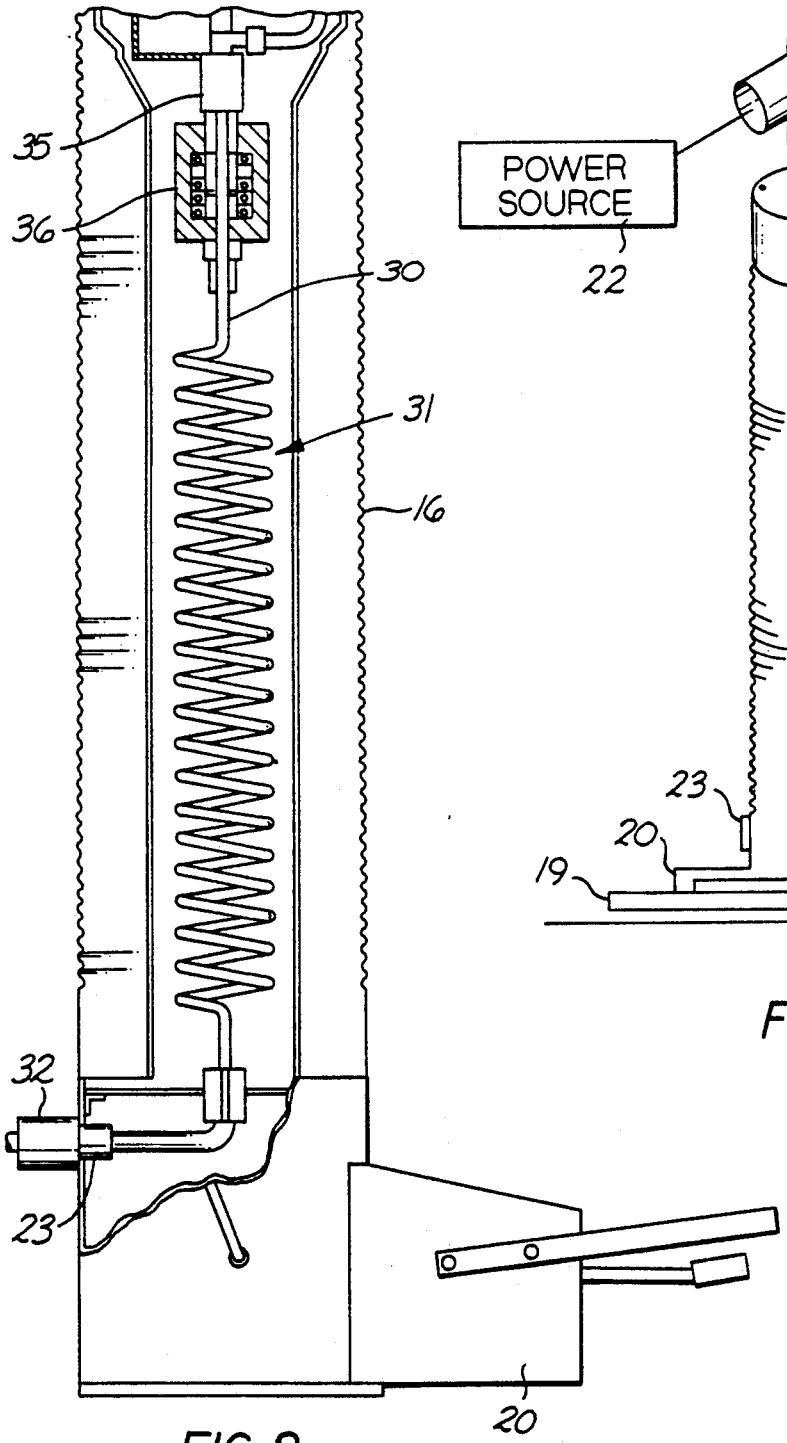
FIG. 2 is a sketch, partly in section, of a manually operated lift head and flexible tubing portion of a lift system embodiment of the invention for providing an auxiliary source of power at the lift head through an internally fed utility line.

Such an internally disposed utility line, namely a compressed air conduit 30, is better shown in FIG. 2. Within the flexible tubing 16 and substantially coaxially located therein, the air conduit 30 is formed as a flexible coiled spring 31 that conforms dynamically with the movement and flexing of the lift body flexible tubing 16. At the lift head 20 therefore, an auxiliary power attachment line can be plugged in conveniently at 32. It is evident that this embodiment neatly and effectively stores the utility line so that it is safe to use.

Figures 3, 4, 5:
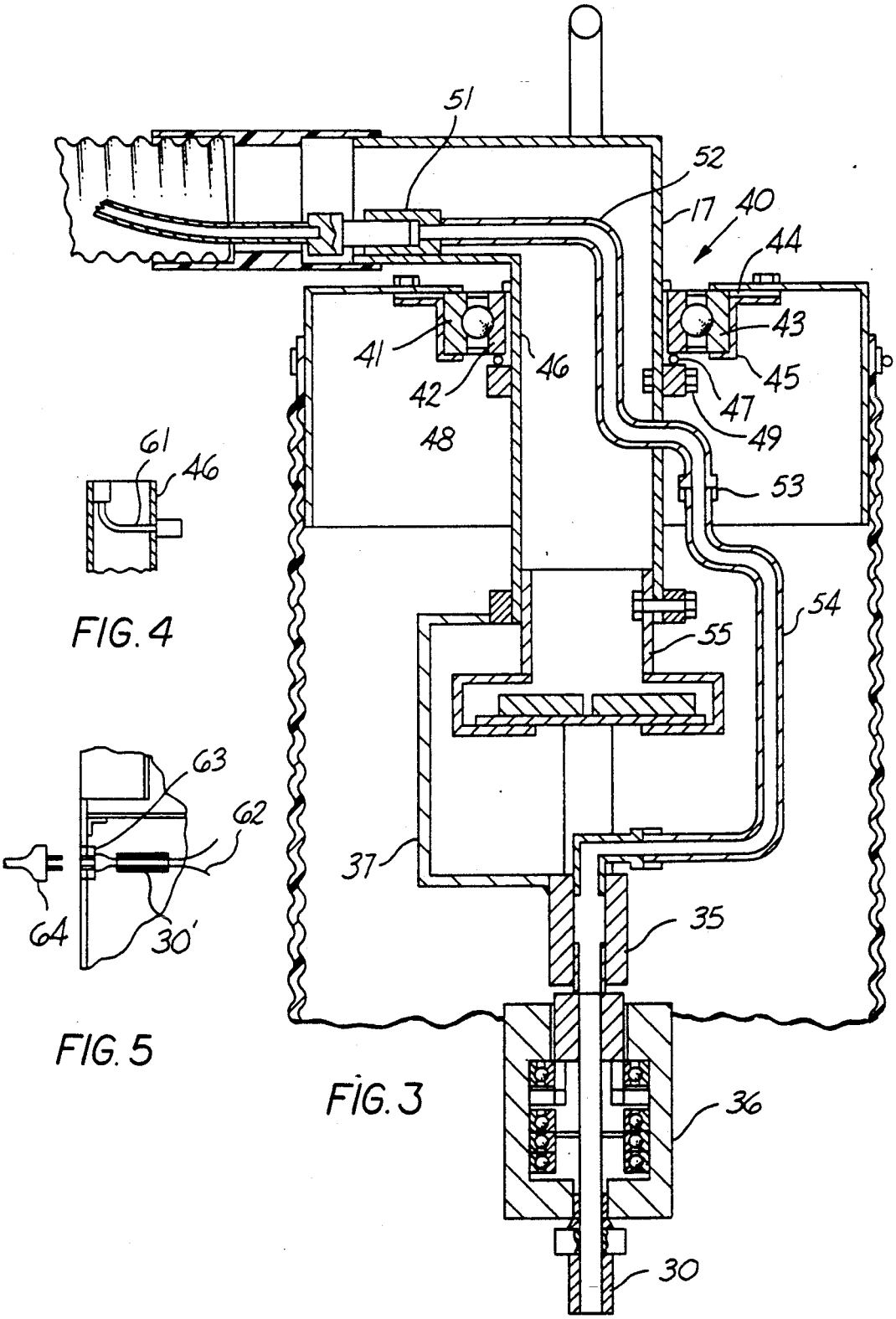
FIG. 3 is a sketch, partly in section, of a rotary joint embodiment of the invention that provides a full 360 degrees of rotation.
FIG. 4 is a fragmental sketch illustrating an embodiment of the invention for introducing an auxiliary source of power internally into the vacuum conveyance conduit of the system.
FIG. 5 is a fragmental sketch of an embodiment of the invention for providing an electrical utility conduit for access at the lift head of the vacuum lift system.

For compatibility with 360 degree rotation of the elastic tubing 16 with respect to the mounting head 17, as better seen in FIG. 3, commercially available rotary compression line fittings 35, 36 are disposed in the line and connected by bracket 37 for support by the mounting head 17. Thus, the utility line 30 as well as the flexible lift tube 16 may be rotated a full 360 degrees relative to the mounting head 17.

The construction of rotating joint 40 is critical to operation, and provides 360 degree rotatability with little manual work effort in a long wear trouble free joint. The ball bearing assembly 41 has an air tight encasement between inner race 42 and out race 43. The outer race is sealed by gasket 44 and held in place by bracket 45, and the inner race 42 surrounds the circular pipe stem 46 of the mounting head 17. The inner race is sealed by O-ring 47 resting on ring 48 bolted (49) to pipe stem 46, so that no movement or wear on gaskets is induced The utility conduit line 30, shown in this embodiment as a pipe for carrying compressed air or hydraulic fluid, is fed inside vacuum conduit tube 50 to coupling 51 and L-joint 52. This L-joint 52 exits the mounting head stem pipe 46 at coupler 53, so that link 54 can by-pass the safety valve assembly 55, which assures a slow lowering of a load in the event of failure of the vacuum power source. Alternatively, the auxiliary power utility line may be disposed through the mounting head stem 46 with L-shaped fitting 61, for example, as shown in FIG. 4.

FIG. 5 shows electric wires 62 in the electric cable utility line 30' alternative, terminating at electrical receptacle 63, where a mating plug 64 of an accessory may be attached.

It is evident therefore that this invention has improved the state of the vacuum lift system art, and provided utility not heretofore available in that art. Accordingly those novel features related to the nature and spirit of the invention are set forth with particularity in the following claims.

We claim:

1. A vacuum lift assembly having a work head coupled to a vacuum source by a flexible tubing that positions the work load by contracting and expanding, comprising in combination: attachment means for movably attaching the lift assembly to a track for supporting movement of a load, a mounting head for coupling the flexible tubing with the attachment means to retain the lift assembly in position for movement along said track, rotating means rotatably coupling the flexible tubing to the mounting head for over 360 degrees of rotation, a utility line for carrying a source of energy, and support means positioning the utility line in said rotating means and flexible tubing to exit at said work head and rotate with the mounting head.

2. The combination of claim 1 wherein said utility line comprises a compressed air conduit line.

3. The combination of claim 1 wherein said utility line comprises an electric cable.

4. The combination of claim 1 wherein said utility line is configured as a coiled flexible spring within the flexible tubing.

5. The combination of claim 1 further comprising a vacuum conduit path through said mounting head including a safety valve for controlling a load drop rate in the presence of a loss of vacuum.

6. The combination of claim 5 further comprising structure in said support means for feeding the utility line around said safety valve.

7. The combination of claim 1 further comprising a utility line for carrying compressed air, a rotary joint coupled in the utility line, and a bracket coupling the rotary joint to the mounting head.

8. A vacuum lift system comprising in combination, a first energy source comprising a vacuum generator, a lift head, a flexible tubing terminating in said lift head, a mounting head including vacuum conduit means for coupling the vacuum generator to said tubing, a rotary joint permitting more than 360 degree rotation of the lift head relative to the vacuum conduit means, a second energy source available at the mounting head for operation of an auxiliary tool connected to the lift head, and a utility conveyance line comprising means for carrying the second source of energy in a parallel path with the vacuum conduit means for use at the lift head and means for rotating the utility line to follow rotation of the lift head.

9. The system of claim 8 wherein the utility conveyance line is an electrical cable carried inside said flexible tubing as a flexible coiled body.

10. The system of claim 9 wherein the utility conveyance line comprises a fluid carrying pipe with said means for rotating the utility line comprising a rotary joint in the fluid carrying pipe located within said flexible tubing.

11. The system of claim 8 wherein the rotary joint comprises a ball bearing assembly with one race affixed to the mounting head and a further race affixed to the flexible tubing.

12. In a vacuum work load conveying system having a vacuum source coupled to a work head manually movable from place to place to attach to and move a work load in response to operation of a vacuum flow valve, the improvement comprising a pair of flexible tubings coupled together in a path between the vacuum source and work head for respectively conveying hydraulic and vacuum energy each tubing comprising independent means for rotation over more than 360 degrees.

13. A vacuum lift system with a vacuum energy source coupled to a manually movable work head by a flexible vacuum conduit that expands and contracts in response to vacuum for positioning loads retains in the work head, rotary coupling means coupling the vacuum source to the flexible vacuum conduit for permitting more than 360 degree rotation of the work head, and conveyance means for supplying an auxiliary energy source to said work head for connection of an accessory with independent structure for permitting 360 degree rotation to follow rotation of the head.

* * * * *